United States Patent [19]

Drexler et al.

[11] Patent Number: 4,711,347

[45] Date of Patent: Dec. 8, 1987

[54] PROTECTIVE ENVELOPE FOR OPTICAL DATA CARD

[75] Inventors: Jerome Drexler, Los Altos Hills; Richard Haddock, Redwood City, both of Calif.

[73] Assignee: Drexler Technology Corporation, Mountain View, Calif.

[21] Appl. No.: 829,802

[22] Filed: Feb. 14, 1986

[51] Int. Cl.[4] ..... B65D 75/28; B65D 85/16

[52] U.S. Cl. ..... 206/38; 40/10 D; 40/159; 150/147; 150/149; 206/39; 206/449; 206/453; 229/68 R

[58] Field of Search ..... 40/10 B, 10 D, 158 B, 40/158 R, 159, 124.2; 150/131, 138, 139, 147–149; 206/37, 38, 39, 39.1–39.8, 449, 312, 444, 454, 455, 456, 453; 229/70, 72, 68 R; 281/31, 40, 41; 235/487, 488, 493

[56] References Cited

U.S. PATENT DOCUMENTS

| | | | |
|---|---|---|---|
| 1,624,719 | 4/1927 | Dixon | 150/147 |
| 2,055,716 | 9/1936 | Berkowitz | 229/72 |
| 2,062,776 | 12/1936 | Berkowitz | 229/72 |
| 2,156,875 | 5/1939 | Schwartz | 150/139 |
| 2,843,310 | 7/1958 | Hopkins | 40/158 R |
| 2,886,907 | 5/1959 | Stephenson | 40/124.2 |
| 3,810,566 | 5/1974 | Adams et al. | 40/158 B |
| 3,838,808 | 10/1974 | Schroeder | 229/72 |
| 3,994,328 | 11/1976 | Reis | 150/147 |
| 4,095,694 | 6/1978 | Jost | 206/455 |
| 4,103,775 | 8/1978 | Smolderen | 206/455 |
| 4,322,001 | 3/1982 | Hurley | 206/449 |
| 4,417,659 | 11/1983 | Hatchell | 206/455 |
| 4,436,202 | 3/1984 | Berkley | 206/455 |
| 4,477,991 | 10/1984 | Drevitch et al. | 40/158 R |

FOREIGN PATENT DOCUMENTS

| | | | |
|---|---|---|---|
| 1926382 | 12/1970 | Fed. Rep. of Germany | 40/159 |
| 1507247 | 11/1967 | France | 150/147 |
| 2105080 | 3/1983 | United Kingdom | 235/493 |

*Primary Examiner*—Jimmy G. Foster

[57] ABSTRACT

A protective envelope having an adhesive flap which lifts open to expose a data storage area of a data card, allowing data to be read while the card remains protected in the envelope. The flap may be then closed over and readhered to the card. The envelope comprises a base and a cover panel bonded at three edges to form a pocket for card storage. The cover panel is made up of a pair of fixed edge stripes bonded to respective opposed side edges of the base and a liftable flap bonded to a back edge of the base. Envelope materials are preferably a transparent, flexible plastic, but only the flap need be flexible. The flap may extend beyond and fold over a front edge of the base and adhere to an underside of the base. An alternative embodiment of the envelope provides two flaps, bonded to respective front and back edges of a base, which open from the center.

26 Claims, 3 Drawing Figures

PROTECTIVE ENVELOPE FOR OPTICAL DATA CARD

DESCRIPTION

1. Technical Field

The present invention relates to protective receptacles for flat objects, and in particular to reusable protective envelopes adapted for receiving and storing cards.

2. Background Art

Credit cards, identification cards and the like are frequently carried in plastic envelopes in wallets or purses. These envelopes typically comprise front and back panels which are sealed together on three edges and left open on one edge, thereby forming a pocket for insertion, storage and removal of the cards.

Hurley, in U.S. Pat. No. 4,322,001, discloses a protective case for a sport card or similar collectible article. The article is enclosed within the protective case, which comprises a base and cover. The base includes a peripheral boss which encircles the article when the article is placed on the base, and the cover includes a downturned edge which interlocks with the boss when the cover is applied to the base. The base and cover are preferably constructed from transparent elastic material, permitting the article to be viewed while inside the case. The case permits viewing without handling, since handling damages the surface of the article.

Berkley, in U.S. Pat. No. 4,436,202, discloses a reusable envelope having front and back panels integrally connected on a fold and forming a pocket between the panels. A pair of opposed side flaps are each attached to respective back panel side edges. Portions of these side flaps are also secured to the front panel's outer surface, thereby forming a pair of closures, between the front panel and respective unsecured portions of the flaps, for slidably receiving and retaining a card insert adjacent the front panel.

Optical data cards typically store data on one or more strips of laser recording material attached to a plastic card base. As the data storage capacity of these cards increases and the size of each data bit decreases, the sensitivity of the card reading system to dust and scratches on the recording material increases. Absorption of moisture by the recording material may cause deterioration of the recording material and loss of data.

It is an object of the present invention to produce a protective envelope for data cards which minimizes handling that can damage the recording material of the cards, permitting the cards to be carried in wallets, purses and pockets.

Another object of the invention is to provide a protective envelope for data cards which permits reading and writing of data without removing the card from the envelope.

A further object of the invention is to provide a protective envelope which prevents accumulation of dirt on the recording material.

DISCLOSURE OF THE INVENTION

The above objects have been met with a protective envelope for data cards which has an adhesive flap. This adhesive flap closes over the card's recording material, thereby protecting the card from damage, lifts open to allow data to be read while the card remains protected in the envelope, and may be readhered over the card. Adhesive coating the flap actually removes dust on the card surface each time the flap is lifted.

The protective envelope comprises a base and a cover panel bonded to at least three edges of the base, thereby forming a pocket therebetween for insertion and retention of a data card. The cover panel is made up of a pair of fixed edge strips bonded to respective opposed side edges of the base and at least one flap bonded to a back edge of the base. The edge strips define slots between the edge strips and the base for retaining the card, while the flap is liftable for exposing a data storage area of the card for reading. Typically, the data storage area is a strip of laser recordable material. A second flap may be bonded to the front edge of the base with both flaps being liftable from a center region between the front and back edges.

The flap may be made from a flexible polymer material and a water impermeable material. Preferably the flaps are adhesive flaps which removably adhere to the data storage area. A seal created when the flap is closed helps protect the card from moisture and accidental opening of the flap by the user, while the adhesive causes dust and other contaminants to adhere to the flap rather than the data storage area. If only one flap is used, it may extend beyond the front edge of the base and overlap and adhere to the underside of the base. Preferably, the flaps are at least as wide as the data storage area and the flaps may overlap the fixed edge strips.

BEST MODE FOR CARRYING OUT THE INVENTION

Figure 1:
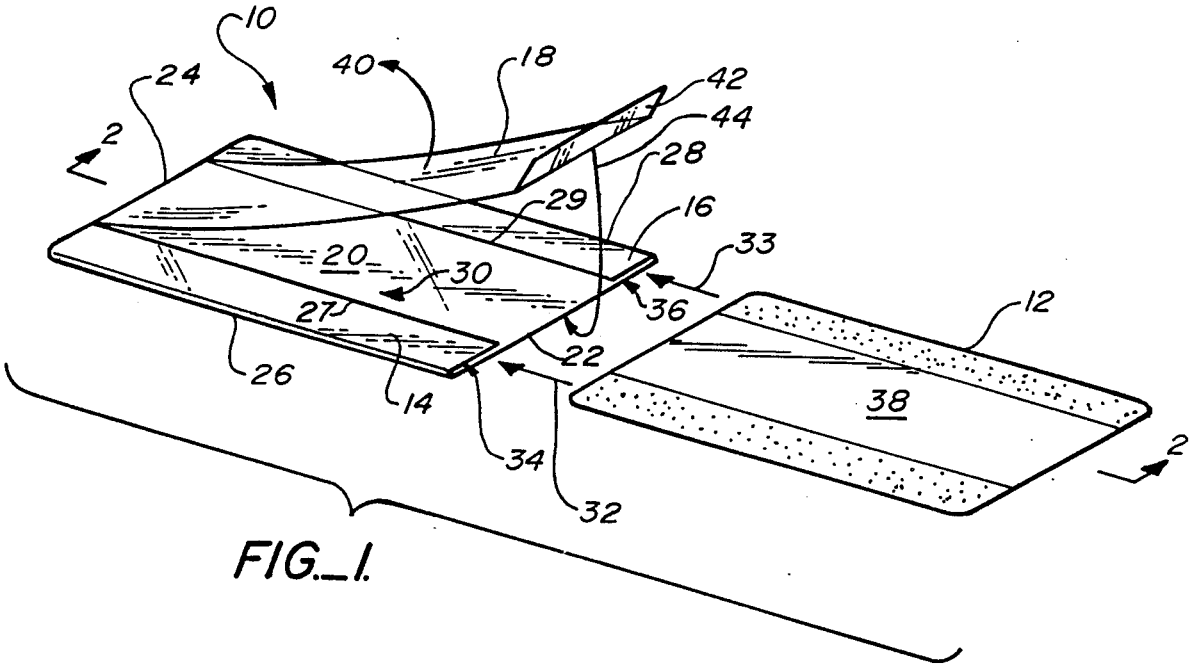
FIG. 1 is a perspective disassembled view of the apparatus of the present invention.
Figure 2:
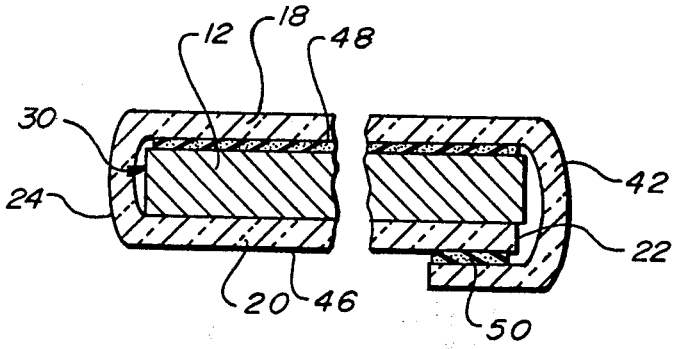
FIG. 2 is a sectional view of the apparatus of FIG. 1 taken along lines 2—2.

With reference to FIGS. 1 and 2, a protective envelope 10 is provided for use with a data card 12. Envelope 10 comprises a flat planar base 20 with front, back and opposed side edges, 22, 24, 26 and 28 respectively, and a cover panel, made up of a pair of fixed edge strips 14 and 16 and a flap 18, bonded to the base at back edge 24 and side edges 26 and 28. Edge strip 14 bonds to base 20 at side edge 26 and back edge 24. Edge strip 16 bonds to base 20 at side edge 28 and back edge 24. Flap 18 bonds to base 20 at back edge 24.

Typically, the cover panel elements 14, 16 and 18 are bonded to base 20 by pressing and heating the elements at the edges until a sealed bond is formed. This heat press process works best when the envelope elements, i.e., edge strips 14 and 16, flap 18 and base 20, are made of heat deformable plastic material. Alternatively, edge strips 14 and 16 and flap 18 may be adhered to the edges of base 20. While the cover panel elements 14, 16 and 18 may be formed and bonded separately to base 20, preferably, for ease of construction, a single unitary cover panel is bonded at edges 24, 26 and 28 to base 20, then edge strips 14 and 16 and flap 18 formed by cutting the cover panel along two lengthwise parallel lines 27 and 29. Also, though cover panel elements 14, 16 and 18 have been discussed above as separate pieces from base 20, the entire envelope 10 may be a single unitary construction with the cover panel elements 14, 16 and 18 demarcated from base 20 by folds along one or both side edges 26 and 28 or back edge 24. For the purposes of this application, the phrase "bonded to the base at the edges" comprises both heat pressed and adhered pieces as well as folds.

Envelope 10 is preferably made of a flexible plastic sheet material. Polyethylene is an example of a suitable plastic material. Water impermeable materials such as polyvinylidene chloride, which is marketed by Dow Inc. under the tradename "Saran", and polytrichlorofluoroethylene (PTCFE), which marketed by Allied Chemical Co. under the tradename "Aclar", and non-transparent hydrophobic materials, such as aluminized mylar and aluminum foil, may also be used. Mylar is a registered trademark of Dupont Co. for a polyethylene terephthalate sheet material. Transparent materials are preferred, at least on one side of envelope 10, so that visibly readable card identifying marks, such as alphanumeric characters, can be seen without removing card 12 from the envelope. Rigid material, such as stiff polycarbonate material, may be used for any of the envelope elements except flap 18, which must be flexible.

Base 20 and the cover panel elements 14, 16 and 18 form a pocket 30 therebetween for insertion of data card 12. Front edge 22 is open, i.e., flap 18 and edge strips 14 and 16 are not permanently bonded to base 20. Data card 12 may be inserted edgewise in the direction indicated by arrows 32 and 33 in FIG. 1 into slots 34 and 36 defined between base 20 and respective edge strips 14 and 16. Once inserted into slots 34 and 36, the card 12 rests securely. Data card 12 may also be removed from envelope 10, if desired, but removal of card 12 is not necessary for reading data on card 12.

Data card 12 has a data storage area 38 thereon, which may be a strip of laser recordable material. Such cards are typically of a size similar to most credit cards. The width dimension of card 12 is approximately 54 mm and the length dimension is approximately 85 mm. These dimensions are not critical but preferred because such a size easily fits into a wallet and has historically been adopted as a convenient size for automatic teller machines and the like. The strip is typically about 35 millimeters wide and extends the length of the card. Alternatively, the strip may have other sizes and orientations, but should accommodate at least 250,000 bits of binary data. The strip is relatively thin, approximately 100–500 micrometers thick, although this is not critical. The strip is applied to the card by any convenient method which achieves flatness, and covered by a transparent scratch resistant laminating sheet.

A high resolution laser recording material which forms data storage area 38 may be any optically reflective recording material so long as the material can be formed on a thin substrate. An advantage of reflective materials over transmissive materials is that the read/-write equipment is all on one side of the card and automatic focus is easier. For example, the high resolution material described in U.S. Pat. No. 4,230,939, issued to de Bont, et al. teaches a thin metallic recording layer of reflective metals such as Bi, Te, In, Sn, Cu, Al, Pt, Au, Rh, As, Sb, Ge, Se, Ga. Materials which are preferred are those having high reflectivity and low melting point, particularly Cd, Sn, Tl, In, Bi, and amalgams.

Suspensions of reflective metal particles in organic colloids also form low melting temperature laser recording media. Silver is one such metal. Preferred recording media are described in U.S. Pat. Nos. 4,314,260, 4,298,684, 4,278,758, 4,278,756, 4,269,917, 4,284,716, 4,312,938, 4,363,870, 4,396,701, 4,383,024, and 4,304,848, all assigned to the assignee of the present invention.

The laser recording material which is selected should be compatible with the laser which is used for writing on it. Some materials are more sensitive than others at certain wavelengths. Good sensitivity to near infrared light is preferred because infrared is affected less by scratches and dirt on the protective layer or laminating sheet. The selected recording material should have a favorable signal-to-noise ratio and form high contrast data bits with the read/write system with which it is used. A large number of highly reflective laser recording materials have been used for optical data disk applications.

The material should not lose data when subjected to temperatures of about 122° F. (50° C.) for long periods. The material should be capable of recording at speeds of at least several thousands bits/sec. This generally precludes the use of materials that require long heating times or that rely on slow chemical reactions in the presence of heat, which may permit recording only a few bits/sec.

Data is recorded by forming spots in the surrounding field of the reflecive layer itself, thereby altering the reflectivity in the data spots. The spots have a recommended size of approximately five microns and may be either circular or oblong, but other size spots may also be created. Preferably, spot sizes should not exceed 50 microns. Data is read by detecting the optical reflective contrast between the surrounding reflective field of unrecorded areas and the recorded spots. Spot reflectivity of less than half the reflectivity of the surrounding field produces a contrast ratio of at least two to one, which is sufficient contrast for reading. Greater contrast is preferred. Reflectivity of the strip field of about 50% is preferred with reflectivity of a spot in the reflective field being less than 20%, thus creating a contrast ratio of greater than two to one. Alternatively, data may also be recorded by increasing the reflectivy of the strip. For example, the recording laser can melt a field of dull microscopic spikes on the strip to create flat shiny spots. This method is described in SPIE, Vol. 329, Optical Disk Technology (1982), p. 202. A spot reflectivity of more than twice the surrounding field reflectivity produces a contrast ratio of at least two to one, which is sufficient contrast for reading.

Flap 18 is liftable in a direction indicated by arrow 40 so as to expose data storage area 38. Preferably, flap 18 is at least as wide as area 38. Flap 18 may overlap fixed edge strips 14 and 16. Flap 18 is preferably longer than base 20, extending beyond front edge 22. The extended flap 18 folds over front edge 22 at a fold 42 and overlaps underside 46 of base 20, thereby further sealing in and protecting card 12.

Flap 18 is preferably an adhesive flap which is removably adherable to data storage area 38. Adhesive 48 coats the underside of flap 18 and should be sufficiently weak to permit easy removal and lifting of flap 18 from area 38. Adhesive 48 should also permit repeated removal and readhesion of flap 18. Adhesive 48 is typically the type used for adhering magnetic material to a substrate, but other well known adhesives may also be used. The same or somewhat stronger adhesive 50 adheres overlapping flap 18 to the underside 46 of base 20. The adhesive 48 permits flap 18 to be rolled back, bent back or otherwise lifted by a card reading machine. Permanent curves or slight bends in flap 18 do not seriously affect its usability because adhesive 48 holds it flat against card 12. Dust particles on data storage area 38 adhere to flap 18 instead of area 38, so they are removed each time flap 18 is lifted, thereby preventing accumulation of dust.

Figure 3:
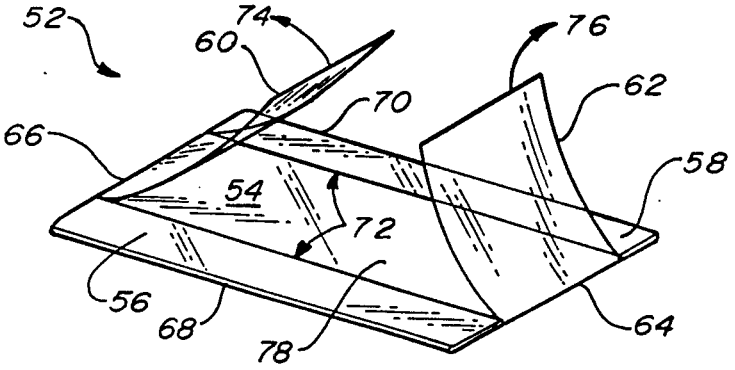
FIG. 3 is a perspective plan view of an alternate embodiment of the present invention.

With reference to FIG. 3, an envelope 52 comprises a base 54, a pair of opposed edge strips 56 and 58, and a pair of flaps 60 and 62. Edge strips 56 and 58 are bonded to base 54 at respective side edges 68 and 70 and both front and back edges 64 and 66. Flap 60 is bonded to base 54 at back edge 66. An additional flap 62 is bonded to base 54 at front edge 64. Bonding of cover panel elements, i.e., edge strips 56 and 58 and flaps 60 and 62, is done in the same way as discussed above with respect to FIGS. 1 and 2, except that front edge 64 is sealed closed by bonds to base 54 of edge strips 56 and 58 and additional flap 62. Suitable materials for envelope 52 are the same as those discussed above for envelope 10.

Edge strips 56 and 58 define slots 72 between base 54 and the edge strips for the insertion and retention of a data card, not shown. The data card is like data card 12 discussed above, and has a data storage area thereon. A data card may be inserted into envelope 52 from a side edge into one and then the other of slots 72.

Flaps 60 and 62 are liftable from a center region 78 of envelope 52, in directions indicated by arrows 74 and 76, to expose the data storage area of a card in envelope 52. Flaps 60 and 62 are preferably at least as wide as the card's data storage area and may overlap edge strips 56 and 58. Preferably, flaps 60 and 62 are adhesive flaps, having a coating of adhesive material applied thereto, so as to permit the flaps 60 and 62 to removably adhere to the card. The adhesive holds flaps 60 and 62 flat against the card so that flaps rolled or bent back by card reading machines do not seriously affect their usability. The adhesive further prevents accidental opening of the flaps. Dust on the card's surface adhere to the adhesive flaps, preventing accumulation of dust.

The dimensions of envelopes 10 and 52 depend on the dimension of the data cards they are to hold. For wallet-size cards, approximately 54 mm by 85 mm, the envelopes typically have dimensions approximately 66 mm by 96 mm. Other envelope sizes may be used for these and other size data cards, provided the envelope is slightly larger than the card to permit easy insertion, yet not so large as to cause the card to be extremely loose.

We claim:

1. A protective envelope for use with a data card comprising, a data card having a data storage area thereon, a planar base member having front, back and opposed side edges, and a cover assembly bonded to said base at said back edge and said opposed side edges thereby forming a pocket between said base and said cover assembly for insertion of said data card.

said cover assembly being made up of a pair of fixed edge strips and at least one flap, said edge strips being spaced apart to define a data storage access area therebetween and being bonded to said base at said back edge and respective side edges, said edge strips projecting inwardly from the respective side edges and extending along substantially the entirety of the side edges, said flap being pivotally bonded to said base at said back edge and being disposed to selectively cover said data storage access area, said fixed edge strips each having a portion spaced apart from said base by the insertion of said data card to frictionally secure said data card when said flap is lifted.

2. The envelope of claim 1 wherein said flap comprises a flexible polymer material.

3. The envelope of claim 1 wherein said flap comprises a water impermeable material.

4. The envelope of claim 1 wherein said flap has a lower surface defining a portion of said pocket and has an upper surface, said flap having adhesive on at least a portion of said lower surface.

5. The envelope of claim 1 wherein said data storage area has a length and a width and said flap is at least as wide as said data storage area, said length of the data storage area traversing said data card.

6. The envelope of claim 1 wherein said flap overlaps said fixed edge strips.

7. The envelope of claim 1 wherein said cover assembly comprises a single flap, said cover assembly being open at said front edge of said base for insertion of a data card.

8. The envelope of claim 1 wherein said cover panel comprises two flaps, one of said flaps being bonded to said base at said back edge, the other of said flaps being bonded to said base at said front edge, said two flaps being liftable from a center region of said panel between said front and back edges.

9. The envelope of claim 7 wherein said flap extends beyond said front edge, said flap being capable of overlapping said front edge and an underside of said base.

10. A protective envelope for use with a data card comprising, a data card having a strip of laser recordable material thereon, a planar base member having front, back and opposed side edges, a pair of fixed edge strips bonded to said base at said back edge and bonded along substantially the entirety of the respective side edges, said edge strips projecting inwardly from the respective side edges and each of said edge strips defining a slot between said edge strip and said base for insertion and retention of the data card, said edge strips being spaced apart to define a data card access area therebetween, and a flap pivotally bonded to said base at said back edge, said flap being repeatedly releasably secured in a first position to combine with said slots and said base to form a pocket for said data card and being pivotal at said back edge to selectively expose said data card access area, said card being laser readable in place in said envelope.

11. The envelope of claim 10 wherein said flap comprises a flexible polymer material.

12. The envelope of claim 10 wherein said flap comprises a water impermeable material.

13. The envelope of claim 10 wherein said flap has a width at least as wide as said strip of laser recordable material and less than the distance between said fixed edge strips.

14. The envelope of claim 10 wherein said flap overlaps said fixed edge strips.

15. The envelope of claim 10 wherein said flap extends beyond said front edge, said base having an upper side and an underside, said upper side forming a first side of said pocket, said flap having a dimension capable of overlapping said front edge and an underside of said base.

16. A protective envelope for use with a data card comprising, a data card having a strip of laser recordable material thereon, a base having front, back and opposed side edges, a pair of fixed edge strips bonded to said base at said back and front edges and at respective side edges, each of said edge strips defining a slot between said edge strip and said base for insertion and retention of the data card, said edge strips being spaced apart to define a data card access area therebetween, and two flaps bonded to said base at front and back edges respectively, both of said flaps being liftable from a center region between said front and back edges, said flaps disposed to selectively cover said data card access area.

17. The envelope of claim 16 wherein said flaps comprise flexible polymer material.

18. The envelope of claim 16 wherein said flaps comprise water impermeable material.

19. The envelope of claim 16 wherein said flaps overlap said fixed edge strips.

20. The envelope of claim 16 wherein said flaps are at least as wide as said strip of laser recordable material.

21. A protective envelope for use with a data card comprising, a data card having a laser recordable material thereon, a base having front, back and opposed side edges, a pair of fixed edge strips bonded to said base at said back edge and respective side edges, each of said edge strips defining a slot between said edge strip and said base for insertion and retention of the data card, and a flap pivotally bonded to said base at said back edge and liftable for exposing at least a portion of said card inserted in said slots, said flap having an adhesive surface so as to be removably adherable to said strip, said card being readable in place in said envelope.

22. The envelope of claim 21 wherein said flap extends beyond said front edge, said flap being capable of overlapping said front edge and an underside of said base.

23. The envelope of claim 22 wherein said flap has an adhesive surface, said flap removably adhering to said strip of laser recording material and to said underside of said base.

24. The envelope of claim 21 wherein said flap is at least as wide as said strip of laser recordable material.

25. The envelope of claim 21 wherein said flap overlaps said fixed edge strips.

26. A protective envelope for use with a data card comprising, a data card having a strip of laser recordable material thereon, a base having front, back and opposed side edges, a pair of fixed edge strips bonded to said base at said back and front edges and at respective side edges, each of said edge strips defining a slot between said edge strip and said base for insertion and retention of the data card, said edge strips being spaced apart to define a data card access area therebetween, and two flaps bonded to said base at front and back edges respectively, both of said flaps being liftable from a center region between said front and back edges for exposing said data card access area said flaps each having an adhesive surface so as to be removably adherable to said strip of laser recordable material.

* * * * *